US007094163B2

(12) United States Patent
Lu et al.

(10) Patent No.: US 7,094,163 B2
(45) Date of Patent: Aug. 22, 2006

(54) ADJUSTABLE GOLF TEE

(76) Inventors: Lay Lu, 2255 Huntley Cir., San Marino, CA (US) 91108; Alex Lu, 2255 Huntley Cir., San Marino, CA (US) 91108; Jing Lu, 2255 Huntley Cir., San Marino, CA (US) 91108

( * ) Notice: Subject to any disclaimer, the term of this patent is extended or adjusted under 35 U.S.C. 154(b) by 55 days.

(21) Appl. No.: 10/962,778

(22) Filed: Oct. 11, 2004

(65) Prior Publication Data

US 2006/0079350 A1 Apr. 13, 2006

(51) Int. Cl.
*A63B 57/00* (2006.01)

(52) U.S. Cl. ..... 473/396

(58) Field of Classification Search ..... 473/386–403
See application file for complete search history.

(56) References Cited

U.S. PATENT DOCUMENTS 2,626,150 A * 1/1953 Karns ..... 473/396
3,954,263 A * 5/1976 Whelan et al. ..... 473/399
4,516,780 A * 5/1985 Tabet ..... 473/398
6,110,060 A * 8/2000 Spoto ..... 473/396
6,328,663 B1 * 12/2001 Lipstock ..... 473/396

* cited by examiner

*Primary Examiner*—Steven Wong
(74) *Attorney, Agent, or Firm*—Roger C. Turner

(57) ABSTRACT

An improved adjustable golf tee comprises a tubular housing, an inner member slideably retained within the housing, and a removable retaining plug inserted into the housing. The tubular housing has an upper end, and a lower end fixed to a base. The lower end of the housing has an opening therein that is suitably generally rectangular in cross section and is beveled outwardly on opposed sides. The inner member has an upper end for supporting a golf ball, a body and a lower portion slideably retained at respective desired positions within the tubular housing. The lower portion of the inner member has two flexible legs that are extendable through the lower opening of the housing. Once the inner member is slid into the desired position, relative to the housing, the legs are extended outwardly along the beveled sides of the lower opening. The removable plug is inserted between the flexible legs of the inner member and wedged into the external lower opening, to fix the flexible legs against the lower end of the housing, to retain the inner member at the desired position.

11 Claims, 5 Drawing Sheets

ADJUSTABLE GOLF TEE

BACKGROUND OF THE INVENTION

The invention relates to a golf tee; particularly to a practice golf tee that is adjustable in height for supporting a golf ball at a desired elevation.

A tee for supporting a golf ball for driving the ball is well known and has long been in use. Golf tees come in various lengths and the height can be varied as desired by the depth that a tee is pushed into the ground at a golf course. Many golfers practice hitting balls at practice ranges that have hitting stations with synthetic turf mats having a permanent tee fixed in the mat. These hitting stations typically have a tee consisting of a soft rubber tube that extends at a fixed height above the mat. Golfers practice with different clubs ranging from wedges to super-sized-head drivers that can best be utilized to hit balls at specific and different respective height above the playing surface. Even golfers using the same sized club have specific preferences in the height for supporting the ball related to their particular swing. There is a long felt need for an effective adjustable golf tee.

There have been numerous attempts to design and develop an adjustable golf tee as evidenced by the large number of prior patents that have issued. Some examples of these prior art patents include: 6,328,663 to Lipstock, 6,086,486 to Murphy et al., 6,083,121 to Hovey and 5,885,174 to Barnes; along with the numerous patents referenced as prior art within these patents, as well as many others. For its simple purpose and function, the designs described in the prior art tend to be complicated with several components (some pivotal or requiring screw threads) and seem to be quite costly to manufacture and assemble, or otherwise may lack dependability or durability. For whatever reason, there are no well known adjustable golf tees currently available in the market, and no adjustable golf tees known for having commercial success.

In view of the foregoing, it is an object of the present invention to provide an adjustable golf tee that is easy to adjust, reliable and durable in retaining the desired height during use.

It is another object to provide an adjustable golf that is robust in design for efficient tooling, manufacturing and assembly, and that can be marketed at a reasonable price.

SUMMARY OF THE INVENTION

The foregoing objects are accomplished by an improved adjustable golf tee comprising a tubular housing, an inner member slideably retained within the housing, and a removable retaining plug inserted into the housing to fix the inner member in a desired position within the housing.

The tubular housing has an upper end, a body, and a lower end fixed to a base. The lower end of the housing has an opening therein that is suitably rectangular in cross section and is beveled outwardly on opposed sides.

The inner member has an upper end for supporting a golf ball, a body and a lower portion slideably retained at respective desired positions within the tubular housing. The lower portion of the inner member has a longitudinal slotted slit providing two flexible legs that are extendable through the lower opening of the housing. Once the inner member is slid into the desired position, relative to the housing, the legs are extended outwardly along the beveled sides of the lower opening The removable plug is adapted to closely fit within the lower opening of the housing. The plug is inserted between the flexible legs of the inner member and wedged into the lower opening, to fix the flexible legs against the lower end of the housing, to retain the inner member at the desired position.

The tee is thereby adjusted at the desired elevation and is placed on or through a practice mat and is ready for use. To adjust the tee to a new desired elevation, the plug is removed, the inner member is slid into the new position, the legs of the inner member are expanded within the lower opening, and the plug is re-inserted and wedged into the lower opening.

The base of the housing can further include recessed channels in the underside and adjacent to the beveled opposed sides thereof to facilitate and position the extended legs of the inner member.

The design is adaptable to a variety of sizes and shapes of the lower opening and a corresponding removable plug. The components of the adjustable golf tee can be suitably molded of thermoplastic, silicone, or nylon material, but are preferably molded of a rubber compound.

BRIEF DESCRIPTION OF THE DRAWINGS

While the novel features of the invention are set forth in the appended claims, the invention will be better understood along with other features thereof from the following detailed description taken in conjunction with the drawings, in which:

DETAILED DESCRIPTION OF THE INVENTION

Figure 1:
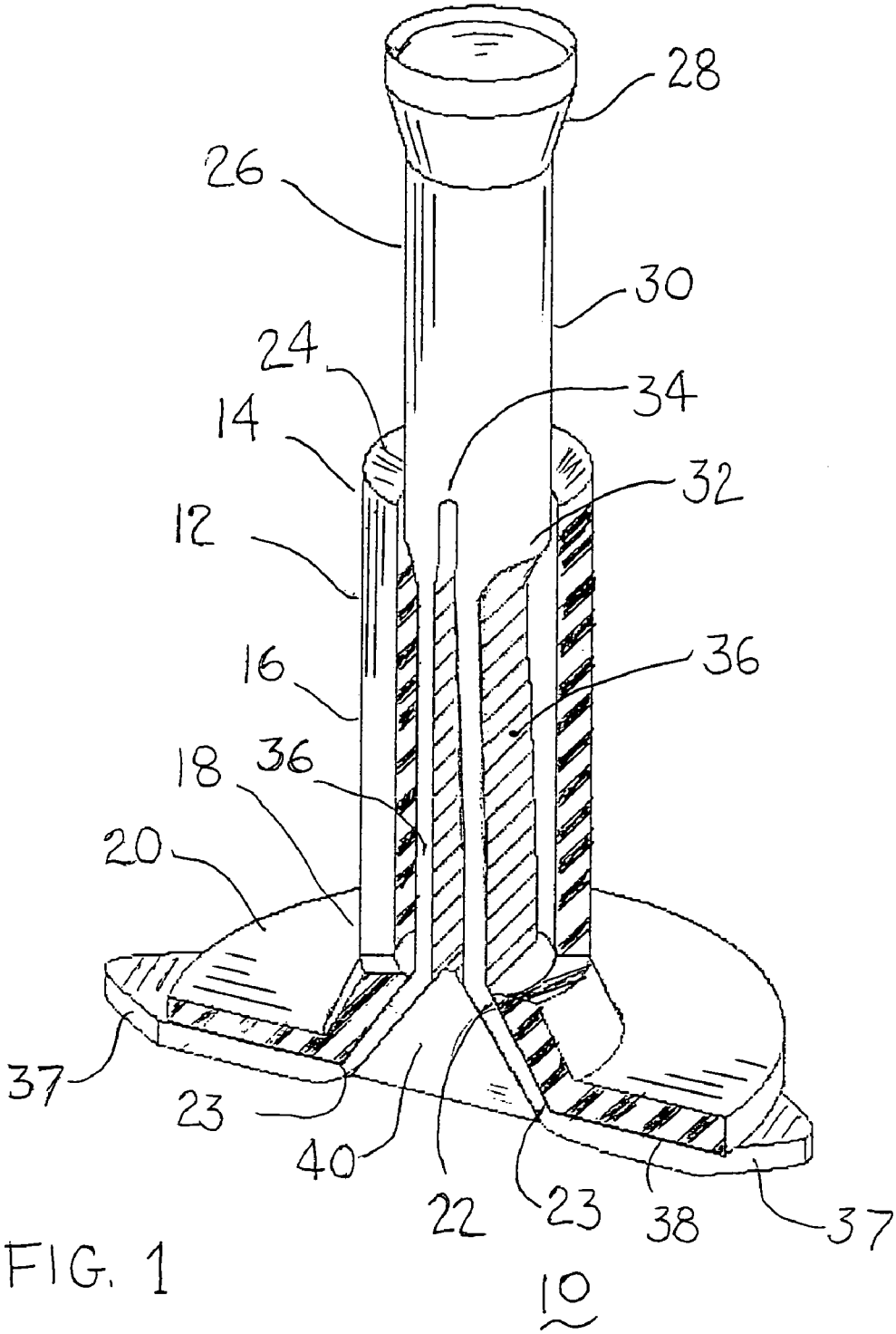
FIG. 1 is a front perspective view of an adjustable golf tee of the present invention, with a housing shown in partial section, and an inner member adjusted into the upper most elevation.
Figure 2:
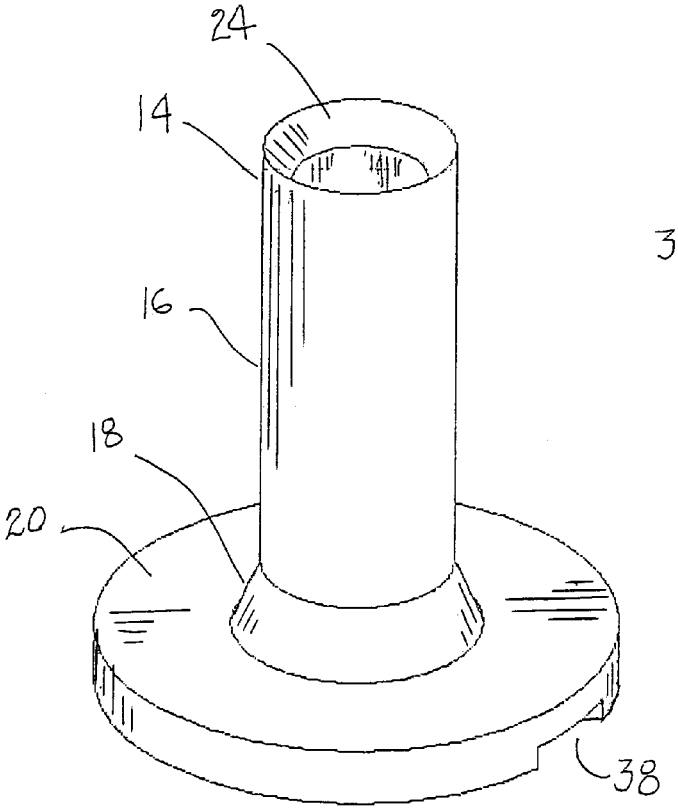
FIG. 2 is a front perspective view of the tubular housing of the adjustable golf tee of the present invention.

Referring first to FIG. 1 there is shown an example of an adjustable golf tee 10 of the present invention, with the tee adjusted into the uppermost position. The tee is usually placed through an opening in a thick practice mat (not shown). Referring also to FIG. 2, the tee includes a tubular housing 12 having an upper end 14, a body 16, and a lower end 18 fixed to a base 20, with the lower end having an opening 22 therein. The housing has a length of about 1.75 inches, and has an outer diameter of about 0.69 inches and an inner diameter of about 0.50 inches. The upper end 18 has an annular beveled rim 24 forming a cup, suitable for supporting a golf ball at this fixed height, and the tubular housing can function as a stand-along golf tee. The housing is typically molded of a flexible rubber compound.

Figure 3:
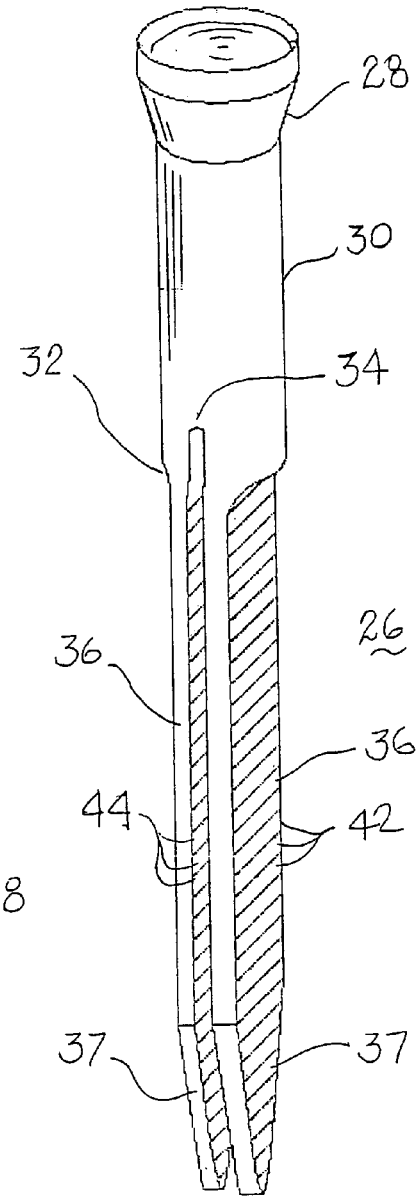
FIG. 3 is a front perspective view of the inner member of the adjustable golf tee.

For those that desire to support a golf ball at a very specific additional height, the adjustable tee includes an inner member 26 as shown also in FIG. 3. The inner member is slidably retained within the tubular housing 12. The inner member has an upper end 28 having a lipped-cup for supporting a golf ball and having a body 30 that is further extendable above the upper end of the housing. The inner member can be adjusted within the housing so that the upper end 28 is positioned at a precise desired height above the surface.

The body 30 of inner member 26 is generally cylindrical in shape having a diameter of about 0.43 inches and a length of about 1.50 inches. The inner member has a lower portion 32 that is necked inwardly, and has a longitudinal slotted slit 34 forming two flexible retaining legs 36 extending downwardly about 2.50 inches. The slotted slit is suitably about 0.08 inches wide, and each leg is suitably about 0.10 inches in thickness, forming a rectangular cross section of about 0.28 inches by 0.43 inches. Alternatively, additional shaped slots can be provided for a three-leg or four-leg configuration. The inner member is typically molded from a flexible rubber compound.

Figure 5:
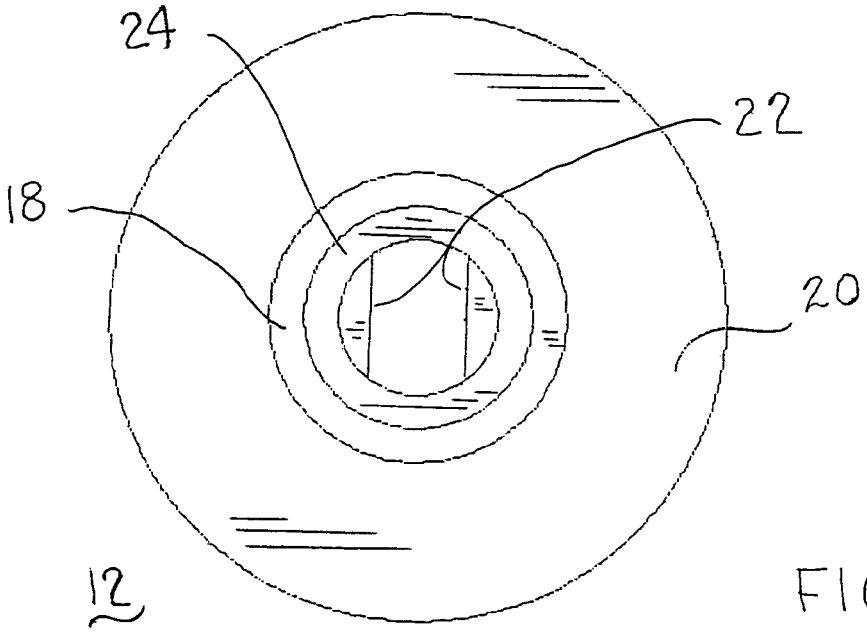
FIG. 5 is a top plan view of the tubular housing of the adjustable golf tee of the present invention.
Figure 6:
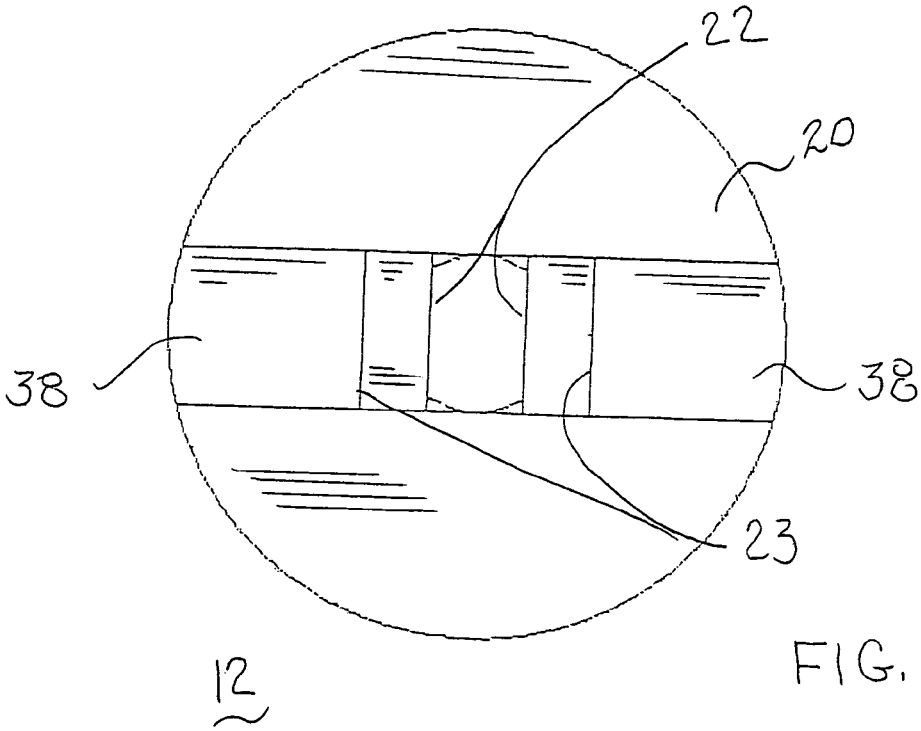
FIG. 6 is a bottom plan view of the tubular housing of the adjustable golf tee of the present invention.
Figure 7:
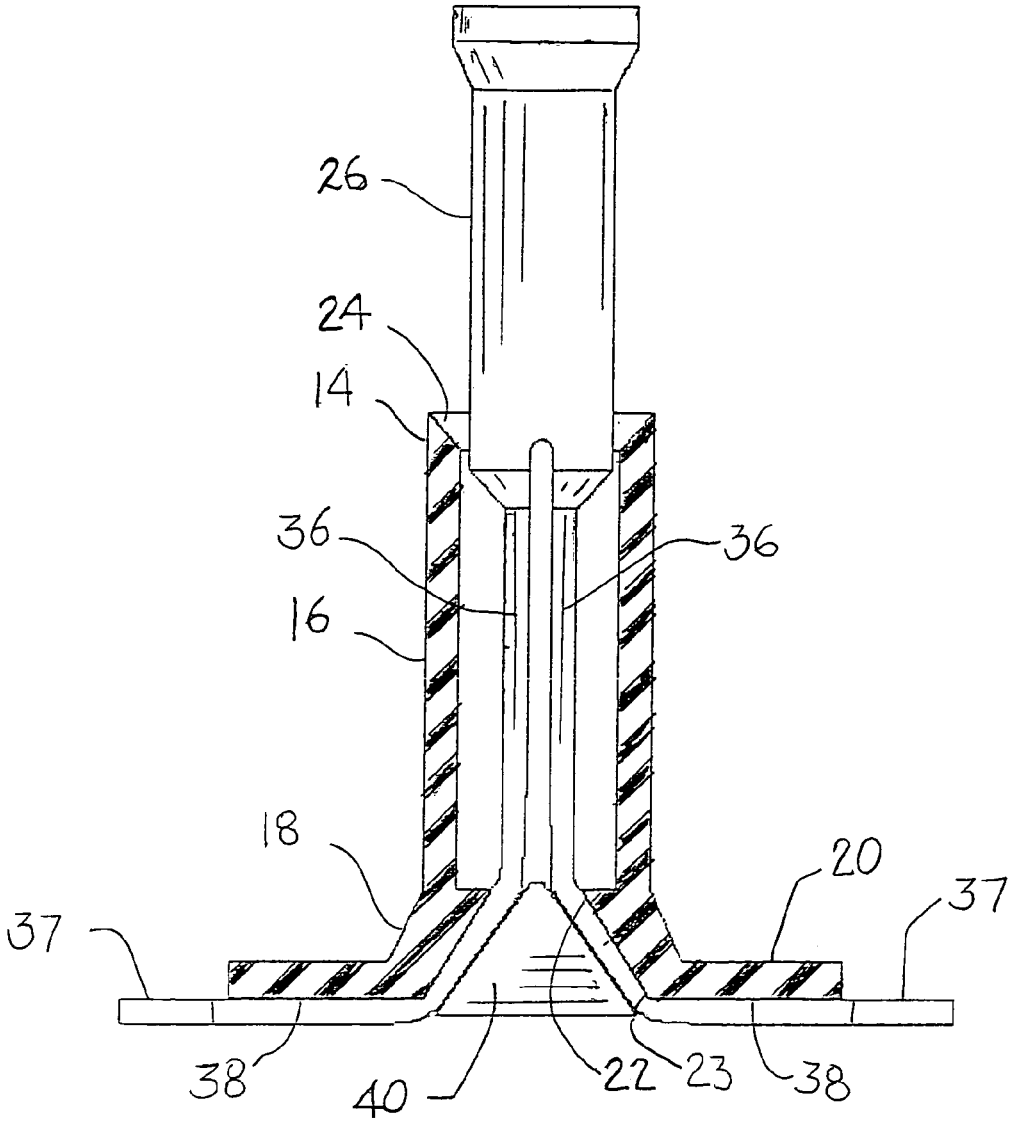
FIG. 7 is a front elevational view, with the housing shown in section, of the of the adjustable golf tee of FIG. 1.

Referring also to FIGS. 5–7 the opening 22 of the lower end of the housing 12 is suitably necked inwardly having an internal generally rectangular cross section (see FIG. 5) of about 0.28 inches by about 0.47 inches, which is closely matched to the rectangular cross section of the two retaining legs 36 of the inner member 26. The lower opening 22 is further beveled outwardly on opposed sides having an external opening 23 having a generally rectangular cross section (see FIG. 6) of about 0.67 inches by 0.47 inches. The lower opening of the housing can be a variety of shapes (cylindrical, flared, frusta-conical, etc.), and the legs of the inner member can be a variety in number, size and shape, so long as the lower opening and the legs are closely matched. The legs 36 preferably have lower tapered ends 37 so they can be easily inserted within the lower opening of the housing and expanded outwardly and against the inner wall of the lower opening. The base 20 of the housing can further include (optional) recessed radial channels 38 so that the extended retaining legs 36 can be nested to maintain a flat stable support for the tee.

Figure 4:
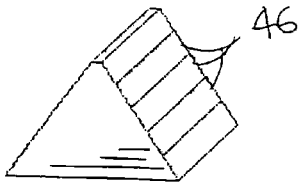
FIG. 4 is a front perspective view of a retaining plug of the adjustable golf tee.

Referring also to FIG. 4, (FIGS. 2–4 collectively provide an exploded view of the components of the adjustable golf tee) the adjustable golf tee is readily assembled, by inserting the inner member 26 into the upper end 14 of the tubular housing 12, with the retaining leg 36 extended downward through the lower opening 22 and out of the external opening 23 in the lower end of the housing. The body 30 of the inner member is slideably retained within the body 16 of the housing. Once the desired elevation of the upper end 28 of the inner member is positioned within the housing, the retaining legs are spread apart, and a removable retaining plug 40 (see FIG. 4) is wedged into the lower external opening 23 of the housing, fixing the retaining legs 36 firmly between the plug and the housing. The retaining legs can then be nested within the recessed channels 38, and the adjusted golf tee is placed within the practice mat and is ready for use at the desired elevation.

The retaining plug 40 can be a variety of sizes and shapes, (rectangular, cylindrical, conical, or pie-shaped wedge), so long as the plug fixes and retains the legs firmly within the housing; and the plug is readily removable and replaceable for adjusting the position of the inner member. In the present example, the plug is a trapezoidal (pie-shaped) wedge having a base width of about 0.59 inches, a height of about 0.40 inches, and an upper tip width of about 0.04 inches; the plug has a length of about 0.39 inches, providing a rectangular base of about 0.59 inches by 0.39 inches. The plug can be solid or hollow and can include a suitable (recessed flange or ring, not shown) handle to facilitate removal. The plug can be suitably tethered to the housing with a flexible line (not shown) so that the plug does not become misplaced from the tee. The retaining plug is suitable molded from a rubber compound, or can also be suitably molded from a thermoplastic compound.

The engagement of the retaining legs 36, the housing 12 and the retaining plug 40 can be further enhanced by lateral serrations 42 on the outer surface of the retaining legs to facilitate fixed engagement with the inner surface of the housing; molding lateral serrations 44 on the inner surface of the retaining legs to facilitate fixed engagement with the retaining plug; and lateral serrations 46 on the surfaces of the retaining plug to facilitate fixed engagement of the plug with the retaining legs and the lower opening of the housing.

Figure 8:
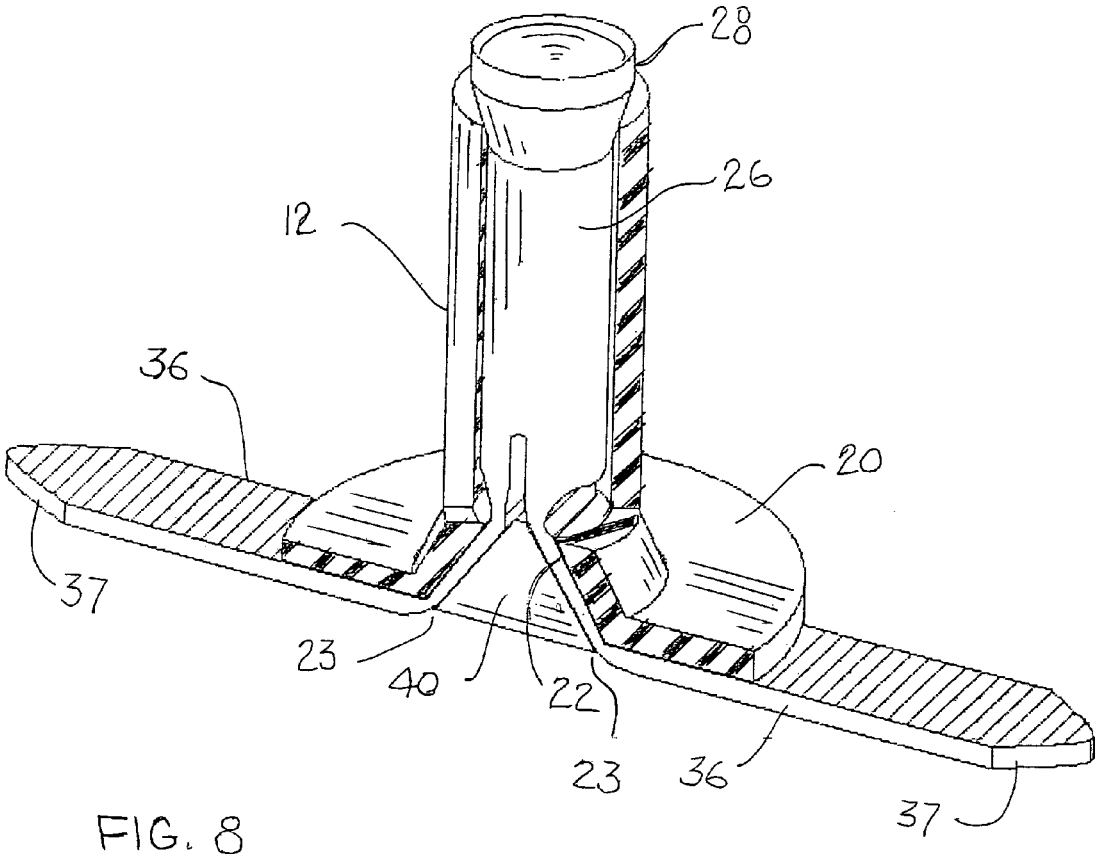
FIG. 8 is a front perspective view, similar to FIG. 1, showing the golf tee adjusted into the lower most elevation.

Referring also to FIG. 8, the adjustable golf tee is shown in the lowermost elevation, and it can be readily described how the golf tee can be readjusted into another desirable elevation. The retaining plug 40 is first removed (by grasping a suitable handle thereon or by pulling on the lower tapered ends 37 of the retained legs 36), which releases the inner member 26 from the housing 12; the inner member is then repositioned within the body of the housing into the new desired elevation; the retaining legs are fully extended to remove any internal slack; the legs are then spread apart at the external opening 23 of the lower opening 22 of the housing; and the retaining plug is then re-inserted and firmly pressed into the external opening of the lower opening. The inner member is thereby fixed in position relative to the housing, and the legs are then extended laterally and nested along the recessed channels of the base. The golf tee can be similarly repositioned to any desired elevation, ranging from the lowermost elevation as shown in FIG. 8, to the uppermost elevation as shown in FIG. 1.

The foregoing example of the present invention provides an adjustable golf tee that is easy to adjust, and is reliable and durable over a long life of countless hits by a golf club. The tee can be robustly and efficiently tooled, manufactured and assembled. The tee can be marketed at a reasonable price, and sold as an assembled tee; the tee can also be sold as unassembled components and readily inserted together by the user; and the components can be sold separately as replacements for any lost or worn out components.

While specific embodiments and examples of the present invention have been illustrated and described herein, it is realized that modifications and changes will occur to those skilled in the art. It is therefore to be understood that the appended claims are intended to cover all such modifications and changes as fall within the spirit and scope of the invention.

The invention claimed is:

1. An adjustable golf tee, comprising:

a tubular housing having an upper end, a body, and a lower end fixed to a base, with the lower end having an opening therein;

an inner member having an upper end for supporting a golf ball, a body and a lower portion slideably retained at respective desired positions within said tubular housing;

the lower portion of said inner member having a slit providing at least two flexible legs that are extendable through the lower opening of said housing; and a removable plug adapted to closely fit within the lower opening of said housing, and positioned between the flexible legs of the inner member, to fix the flexible legs against the lower end of said housing, to retain the inner member at a desired position.

2. The adjustable golf tee as in claim 1, wherein the base of said housing further includes recessed channels in the underside thereof for receiving the legs of the inner member.

3. The adjustable golf tee as in claim 1, wherein the lower opening of said housing is rectangular in cross section.

4. The adjustable golf tee as in claim 1, wherein the lower opening of said housing is rectangular in cross section, and is beveled outwardly on opposed sides; and said removable plug is a trapezoidal shaped wedge.

5. The adjustable golf tee as in claim 1, wherein the lower opening of said housing is annular in cross section, and is beveled outwardly; and said removable plug is a frustaconical shaped wedge.

6. The adjustable golf tee as in claim 1, wherein the flexible legs of said inner member have tapered lower ends to facilitate insertion into the lower opening of said housing.

7. The adjustable golf tee as in claim 1, wherein the lower portion of said inner member further having a slit providing three flexible legs thereon.

8. The adjustable golf tee as in claim 1, wherein the lower portion of said inner member further having a slit providing four flexible legs thereon.

9. The adjustable golf tee as in claim 1, wherein said tubular housing has an outer diameter of about 0.69 inches, an inner diameter of about 0.50 inches, a length of about 1.50 inches, and a circular base of about 1.75 inches in diameter and about 0.19 inches in thickness;

The body of said inner member is cylindrical in shape having a diameter of about 0.43 inches and a length of about 1.50 inches; and the flexible legs are about 2.50 inches in length, about 0.43 inches wide and about 0.10 inches thick.

10. The adjustable golf tee as in claim 1, wherein at least one of said tubular housing, said inner member and said plug is formed of a rubber compound.

11. The adjustable golf tee as in claim 1, wherein at least one of said tubular housing, said inner member and said plug is formed of a thermoplastic material.

* * * * *